US007283638B2

(12) United States Patent
Troelsen et al.

(10) Patent No.: US 7,283,638 B2
(45) Date of Patent: Oct. 16, 2007

(54) HEARING AID WITH ERROR PROTECTED DATA STORAGE

(75) Inventors: Casper Kruger Troelsen, Stenlose (DK); Rene Mortensen, Copenhagen (DK)

(73) Assignee: GN ReSound A/S (DK)

( * ) Notice: Subject to any disclaimer, the term of this patent is extended or adjusted under 35 U.S.C. 154(b) by 688 days.

(21) Appl. No.: 10/007,823

(22) Filed: Nov. 13, 2001

(65) Prior Publication Data

US 2002/0071582 A1 Jun. 13, 2002

(30) Foreign Application Priority Data

Nov. 14, 2000 (DK) ..... 2000 01702

(51) Int. Cl.
*H04R 25/00* (2006.01)

(52) U.S. Cl. ..... 381/312; 381/314

(58) Field of Classification Search ..... 381/312, 381/313, 60, 314–318, 320–321; 600/559
See application file for complete search history.

(56) References Cited

U.S. PATENT DOCUMENTS 4,972,487 A 11/1990 Mangold et al. ..... 381/68
5,600,728 A 2/1997 Satre
5,600,827 A 2/1997 Nakabayashi et al.
5,838,806 A * 11/1998 Sigwanz et al. ..... 381/312
6,741,712 B2 * 5/2004 Bisgaard ..... 381/312
6,782,110 B1 8/2004 Sigwanz et al.

FOREIGN PATENT DOCUMENTS

| | | |
|---|---|---|
| DE | 197 34 723 C1 | 11/1997 |
| EP | 0 341 908 A2 | 11/1989 |
| EP | 0 803 812 A1 | 10/1997 |
| JP | 10-229598 A | 11/1998 |

OTHER PUBLICATIONS

European Search Report—Documents Considered to Be Relevant for Application No. EP 01 20 4316 and Annex to the European search Report on European Patent Application No. EP 01 20 4315. (3 pages).

* cited by examiner

*Primary Examiner*—Suhan Ni
(74) *Attorney, Agent, or Firm*—Bingham McCutchen LLP

(57) ABSTRACT

The invention relates to an improved method of storing data within a persistent data space of a hearing aid and a hearing aid utilizing the improved storage methodology. The invention prevents that erroneous or corrupted data are written into and/or loaded from the persistent data space due to unexpected and uncontrollable power supply failures in the hearing aid.

22 Claims, 2 Drawing Sheets

HEARING AID WITH ERROR PROTECTED DATA STORAGE

This application claims the benefit of Denmark patent application No. PA 2000 01702, filed on Nov. 14, 2000, the entire disclosure of which is incorporated by reference herein.

FIELD OF THE INVENTION

The present invention relates to an improved method of storing data within a persistent data space of a hearing aid and a hearing aid utilising the improved storage methodology. The invention prevents that erroneous or corrupted data are written into and/or loaded from the persistent data space due to unexpected and uncontrollable power supply failures in the hearing aid.

BACKGROUND OF THE INVENTION

It is generally desirable to be able to write various hearing aid associated data to a persistent data space within the hearing aid during its normal operation. A hearing aid provided with such a data writing capability is able to record or log information within the persistent data space about various hearing aid associated variables or parameters such as a patient's utilisation pattern of user-selectable listening programs, volume control settings, sound or listening environment information based on input sound pressure level statistics etc. Furthermore, the data writing capability also allows the hearing aid's processor to execute slowly converging adaptive signal processing algorithms and regularly store current values of variables associated with the adaptive algorithm. This latter feature is particularly advantageous in connection with algorithms which have very small adaptation rates. Such slowly adapting algorithms may be unable to converge during a typical daily utilisation time of the hearing aid, i.e. a time period somewhere between 6–12 hours. One example of such a slowly converging algorithm, relating to maintaining long-term sensitivity balance between a pair of microphones, is disclosed in the present applicant's co-pending application PA 2000 01407.

Writing data to the persistent data space during normal operation of the hearing aid poses, however, a significant problem that has not been properly addressed by the prior art: in existing hearing aid designs, the user is allowed to remove or interrupt the normal power source, often a single 1.3 Volt Zinc-Air battery, at arbitrary instants in time. Simply opening a battery compartment of the hearing aid or actuating a mechanical power switch may accomplish the interruption. If a hearing aid processor has initiated a data write procedure in the persistent data space when such an uncontrollable power failure occurs, these data will inevitably be corrupted.

Accordingly, handling and securing correct writing of data to the persistent data space during normal operation of the hearing aid is more difficult than the well-known procedure of writing data to the persistent data space in the initial fitting situation in a hearing aid dispenser's office. In the latter situation, a connected host programming system can easily be programmed to secure that only uncorrupted data are loaded into the hearing aid because the fitting program can easily be adapted to confirm that down-loaded data are correct, e.g. by using a simple write, read-back and compare procedure.

A hearing aid with a dynamic data logging capability is disclosed in U.S. Pat. No. 4,972,487 in the form of a digitally programmable hearing aid that includes a data logging circuit and provides a number of different user-selectable listening programs. The data logging circuit is utilised to record log-data relating to how many times the user switches between the listening programs and a utilisation time of each of the listening programs. The recorded log-data are stored in a battery backed-up RAM area to allow the logged-data to be retained during battery supply interruptions in the hearing aid. A bi-directional serial programming interface is furthermore included in the disclosed hearing aid making it possible for a host programming system, typically located in a dispenser's office, to read and display the logged-data. However, the patent specification contains no suggestion of how to detect and/or correct data errors to secure that the logged data are valid.

DE 197 34 723 to Siemens Audiologische Technik discloses a Digital Signal Processing(DSP) hearing aid adapted to perform an internal detection and/or correction of errors in data storage and data transmission operations between a secondary storage area and a working memory area. The proposed error detection and/or correction schemes are based on well-known checksum, parity or Hamming coding techniques. However, the proposed application of Hamming coding to detect and correct data errors is costly in terms of memory overhead and processing power and/or in terms of dedicated hardware such as data test elements adapted to perform the necessary computations on the data. Furthermore, Hamming coding can typically only detect and correct a minor parts of the bits in a corrupted set of data and will therefore not be able to correct errors within a completely corrupted data set which may result from uncontrollable power failures in the power supply of the hearing aid.

Accordingly, there is a need to provide a simple, cost-effective and reliable method of writing and storing values of various hearing aid associated variables in a persistent or retained data space, typically arranged inside an EEPROM device, of the hearing aid during normal operation of the aid.

SUMMARY OF THE INVENTION

One object of the invention is to provide a hearing aid and a corresponding method that allow various types of data generated by the processor during normal operation of the hearing aid to be reliably written to the persistent memory space of the hearing aid.

DESCRIPTION OF THE INVENTION

A first aspect of the invention relates to a method of saving data within a persistent data space of a hearing aid, the method comprising the steps of;

processing an input signal by a processor according to a predetermined algorithm to generate a processed output signal, generating a plurality of data sets, representing respective values of predetermined hearing aid associated variable(s), by the processor, writing the plurality of data sets to respective storage areas within the persistent data space, indicating a valid data set, of the plurality of data sets, by setting a value of at least one data variable in the persistent data space.

In the present specification and claims, the term "processor" designates one or several separate processors and its/their associated memory circuitry, either arranged on a common integrated circuit substrate or distributed over several integrated circuit substrates. The processor may comprise a Digital Signal Processor (DSP) such as a proprietary or commercially available fixed or floating point DSP circuit or core. The DSP may be a software programmable type adapted to apply one or several different signal processing algorithms to the input signal in accordance with respective instructions set(s) held in an associated program RAM during execution of these algorithms. Alternatively, the processor may be constituted by, or at least comprise, a hard-wired DSP designed to execute one or several fixed signal processing algorithm(s) in accordance with respective fixed set(s) of instruction(s) from an associated logic controller. If the processor comprises two or more separate processors, e.g. a Digital Signal Processor (DSP) and an industry standard micro-controller, each processor may be tailored to perform only certain operations of the claimed methodology. Thereby, the total computational load associated with the present task can be divided into appropriate subtasks, where each such subtask may be tailored to specific characteristics of its associated processor.

In the present specification and claims, the term "persistent data space" or "persistent memory device" designates a memory space or device, respectively, wherein data are retained or held during time periods where the hearing aid's normal power supply source, typically a 1.3–1.5 Volt Zinc-Air battery, is interrupted or discharged. Data may be retained by locating the persistent data space within one or more non-volatile memory devices such as EPROM, EEPROM and/or Flash-memory devices. Such non-volatile memory devices may be provided as external, separate, memory circuits communicating with the processor/DSP over a suitable, typically serial, programming interface. The non-volatile memory device(s) may be alternatively have been integrated with the processor/DSP to provide a single chip solution. Alternatively, the persistent data space may be located within a volatile memory type such as a RAM device or register file connected to a suitable a back-up power supply source, such as a back-up battery or a supercharge capacitor.

The plurality of data sets represent respective values of a predetermined hearing aid associated variable or variables. Hearing aid associated variables may comprise one or several DSP algorithm parameter(s) and/or various other types of hearing aid associated variables related to the operation of the hearing aid or a user interface of the hearing aid. The hearing aid associated variables may therefore comprise statistical data relating to the hearing aid user's selection of preset listening programs, long-term or short-term spectral properties of microphone input signals, utilisation time of the hearing aid etc. A parameter of the DSP algorithm may be a volume control setting or a gain multiplier of a gain scaling operation within an input signal channel of the hearing aid. As previously-mentioned, such an algorithm may be designed with a very small adaptation rate in order to compensate for long-term drift in matching characteristics between the pair of microphones. According to such an embodiment of the invention, appropriate gain multiplier values for the gain scaling operation are continuously calculated by the processor based on running average signals levels from the microphones. The determined gain multiplier values are written at regular time intervals, and in an alternating manner, to the plurality of storage areas within the persistent data space. Consequently, if one of the gain multiplier values has been corrupted by a power failure during writing to the persistent data space, vital information of the microphone matching algorithm has not been lost, since the last but one gain multiplier value is retrievable from the valid data set indicated by the at least one data variable. Accordingly, the adaptive microphone matching algorithm will not need to be restarted with an incorrect default value of the gain multiplier which would have lead to an inaccurate initial matching between the microphones and compromised the performance of the hearing aid.

After one data set of the plurality of data sets has been successfully written to the persistent data space, the at least one data variable in the persistent data space is set to a value or state which indicates that the data set in question is the valid set of data. The value of the at least one data variable may advantageously be set immediately after a data set has been successfully written to indicate that the data set in question is the valid data set. Thereby, the most recently stored data set will constantly be identified as the valid data set. The plurality of data sets is preferably written to their respective storage areas within the persistent data space in an intermittent manner.

The advantages of the above-described scheme will be explained in the following: In case a power failure occurs during a write cycle to one of the data sets within the persistent data space, the data set in question will be corrupted. However, because such a power failure will occur prior to the intended subsequent setting the data variable value, which would have indicated the set of data in question to be valid, the value or state of the at least one data variable will not be altered to indicate the data set in question to be valid. Thus, the at least one data variable value will correctly indicate the previous data set to be the valid set of data. Alternatively, in case the set of data in question is successfully written to the persistent data space and the at least one data variable correspondingly set to indicate so, it can safely be assumed that this set of data is valid, because otherwise the value of the at least one data variable would never have been set.

Naturally, at a given point in time, each of the plurality of data sets may constitute a valid data set in the sense that none of them have been corrupted e.g. by a power failure, which presumably should be a relatively rare event. In that situation, the at least one data variable merely serves to indicate which data set that most recently has been updated. The crucial point remains, however, that the duplicate storage technique used in respect of the predetermined hearing aid associated variable(s) secures that at least one of the plurality of data sets always contains uncorrupted value(s) of the predetermined hearing aid associated variable(s) on which the processor can safely rely. Since DSP based hearing aids usually will perform a processor reboot after a power failure has occurred, or after actuation of a power ON/OFF switch has taken place, the processor may advantageously be adapted to access or read the value of the at least one data variable during such a reboot process to determine which of the plurality of data sets to use.

According to a preferred embodiment of the invention, the plurality of data sets is constituted by a first and a second data set and the at least one data variable comprises a single binary data variable, having only two possible values or states, indicating the valid data set. Thereby, it is avoided that power failures that occurs during writing or setting of the value of the at least one data variable in the persistent data space leads to an ambiguous value of the data variable.

Each data set may be stored within an associated storage area of the persistent data space together with an associated data variable that indicates whether the set of data in question is valid. The associated data variables may be represented by respective counter values, e.g. inserted in respective headers in an initial part of each set of data. The counter values may be related to a clock period counter of the hearing aid and therefore represent respective values of the hearing aid's accumulated utilisation time. Each counter value may be written to its associated data set immediately after a successful writing of that data set has been completed. Thereby, each set of data will comprise a time stamp, that will indicate the time at which the data set in question was stored. Consequently, the valid set of data, among the plurality of data sets, may be assumed to be that set of data which has the highest counter value, i.e. the most recently stored set of data. According to this embodiment of the invention, each set of data contains an associated data variable that indicates whether the set of data in question is valid. The processor will, e.g. at boot time, be able to determine which data set of the plurality of stored data sets that is valid based on the values of the plurality of data variables.

Alternatively, the at least one data variable may be constituted by single data variable, capable of assuming more than two differing values so as to indicate which of the plurality of data sets that is valid even if three or more data sets are utilised. The data variable may accordingly function as a pointer to the valid set of data either by directly or indirectly pointing to the valid data set. In such an embodiment of the invention, the data variable may advantageously be stored in a storage area within the persistent data space separate from the storage areas of the plurality of data sets.

In the above-mentioned embodiments of the invention that utilises a non-binary data variable or several data variables, each of the variables will typically have a length of 8–32 bits and may therefore be vulnerable to corruption if a power failure happens during a write sequence of a data variable itself. To combat this, each data set, of the plurality of data sets, may be associated with error detection or error correction code within the persistent data space that allows the processor to determine whether a given data set is corrupted before this data set is loaded into the processor. If the initially indicated set of data has, e.g. an erroneous checksum, the processor may proceed by skipping that set of data and thereafter identify and load another data set according to a predetermined order, e.g. the data set with the most recent time stamp or the highest counter value after the initial set of data has been skipped.

The predetermined algorithm may comprise a number of separate signal processing algorithms, such as digital signal processing algorithms, that each implements a particular signal processing operation on the input signal or a signal derived therefrom such as multichannel compression, adaptive microphone matching, frequency response shaping, adaptive feedback cancellation etc. The plurality of data sets may comprise respective parameter values of these separate signal processing algorithms. Furthermore, the data sets may comprise respective signal events associated with a user interface part of the hearing aid, such as preset switch operations, volume control manipulations and/or statistical information related to these events.

According to an important embodiment of the invention, the hearing aid associated variable comprises an accumulated utilisation time value of the hearing aid. In this latter embodiment of the invention, the hearing aid is adapted to, regularly, determine its accumulated utilisation time and record/update this accumulated utilisation time by writing the current value of same to the data sets in an intermittent manner. This embodiment of the invention allows the processor to control one or several functions of the hearing aid based on the accumulated utilisation time. Such a hearing aid may be sold on a subscription arrangement and therefore adapted to cease operating after a certain predetermined prescription time period has expired. By storing respective accumulated utilisation time values in the plurality of data sets, it can be secured that even if one of the data sets at some point in time gets corrupted, it is always possible for the processor to recover a sufficiently accurate value of the accumulated utilisation time from one of the other data sets and thus prevent e.g. a premature and incorrect interruption of the hearing aid's operation.

If the retained memory area is located within an EPROM or EEPROM or flash memory device, it may be desirable to limit the total number of times that a data set is written to this type of memory device. EEPROM devices and other types of non-volatile memory can usually withstand only a limited number of write cycles, such as 10,000 or 100,000 write cycles. Therefore, updated data in each of the plurality of data sets may stored at a rate lying somewhere in a time interval of 1–60 minutes, or more preferably between 5–20 minutes. Another method of prolonging the lifetime of the persistent data space is to use a large number of data sets and corresponding storage areas, e.g. between 4–32 data sets such 8–16 data sets, and respective storage areas. Thereby, the number of times that any specific storage area in the persistent data space will be written during the hearing aid's lifetime is reduced. For some applications, where the data sets are large, it may clearly be impractical to occupy memory space for such a large amount of data. On the other hand, for small data sets, that each may occupy only a few bytes or words, it is possible to use a large number of data sets, such as the above-mentioned 4–8 data sets, and thereby prolong the lifetime of the memory device.

The storage area of the at least one data variable may be located adjacent to one or two of the storage areas that hold the predetermined hearing aid associated variables. Alternatively, if a plurality of data variables is used, each of these may be stored inside its associated storage area.

If the persistent data space is arranged inside a single memory device, which is internally divided into a number of predetermined and distinct memory segments, it is preferred and advantageous to arrange each storage area, and consequently each associated data set, entirely in its own dedicated memory segment. Likewise, it is preferred to locate the at least one data variable in its own dedicated memory segment also.

A second aspect of the invention relates to a hearing aid comprising a persistent data space and a processor adapted to perform any of the above-mentioned methods of saving data in the persistent data space. The processor may comprise a software programmable Digital Signal Processor adapted to perform the method under control of a predetermined set of processor instructions that may be loaded into the DSP's program RAM from the persistent data space at boot time.

A third aspect of the invention relates to a hearing aid adapted to store values of hearing associated variables in a persistent memory device during normal use of said hearing aid, the hearing aid comprising; an input signal channel providing an input signal, and a processor adapted to:

process the input signal according to a predetermined algorithm to generate a processed output signal, generate a first data set representing a value or values of one or several predetermined hearing aid associated variable(s), writing the first data set to a first memory segment within the persistent memory device, generate a second data set representing a value or values of the one or several predetermined hearing aid associated variable(s), writing the second data set to a second memory segment within the persistent memory device, selectively indicating the first or the second data set as a valid data set by setting a data variable value in a third memory segment in the persistent memory device.

According to this aspect of the invention, a persistent data space is arranged inside a single memory device, such as a serial EEPROM, which is internally divided into a number of predetermined and distinct memory segments. A memory segment is in this context the smallest memory area that is write-able in a single write operation to the persistent memory device. The size of such a minimum memory segment, often denoted "page", is typically between 32–128 bytes such as 64 bytes in commercially available serial persistent memory devices. According to the present aspect of the invention, the first and second data sets are stored in different memory segments and the data variable in yet another and different memory segment. Since a write operation to a memory segment within the persistent memory device only operates on the contents, or data, of the currently active memory segment, a power failure will solely corrupt the data set in that memory segment. The other memory segment, or page, and the data variable will be left unaffected and therefore still hold uncorrupted data, which the processor can retrieve and use.

The data variable is preferably constituted by a single binary data variable

A fourth aspect of the invention relates to a method of saving data within a persistent data space of a hearing aid. The method comprising the steps of:

processing an input signal by a processor according to a predetermined algorithm to generate a processed output signal, generating a plurality of data sets, representing respective values of predetermined hearing aid associated variable(s), by the processor, generating for each data set, an associated error detection code, writing the plurality of data sets and the associated error detection codes to respective storage areas within the persistent data space.

According to this fourth aspect of the invention, the data corruption is avoided by storing the plurality of data sets, i.e, at least two data sets, together with respective associated error detection codes. When the processor loads a data set from the persistent data space to determine appropriate values of the hearing aid associated variable(s), it may start out by loading a first data set and the error detection code associated with that data set By analysing the data set together with the error detection code, the processor will be able determine whether the currently loaded data set is valid or not. If it is determined that the currently loaded data set is invalid, the processor may proceed by loading a second data set and its error detection code from the persistent data space and once again determine whether this second data set is valid or not. Usually, if the first data set has been corrupted by e.g. a power failure, the second data set will be uncorrupted because the latter was written before the power failure took place. As previously-mentioned, a data set may be corrupted, e.g due to an uncontrollable power supply failure, to an extent that makes it impossible to recover that data set by commonly used error correction codes. Contrary to this latter situation, the present method of storing at least two data sets which hold respective value(s) of the predetermined hearing aid associated variable(s), preferably in an alternating manner, secures that at least one valid data set always will be retrievable from the persistent data space.

According to this fourth aspect of the invention, the processor will not be capable of identifying the valid data set from an examination of a data variable. Instead, a search strategy may be used to examine, from an arbitrary starting point, the plurality of stored data sets until a valid data set is located or identified. Once such a valid data set has been identified, the processor may proceed by using this data set even though it can not be guaranteed that that data set really is the most recently stored data set. However, for many applications, that fact will not constitute a significant problem, since this potential loss of the most recent data set effectively corresponds to adjusting values of the hearing aid associated variables back to those values which they had e.g. 5–20 minutes ago. Finally, if for the application in question, it is strictly necessary to be able to identify the most recently stored data set, one or several appropriate data variables pointing to, or indicating, the valid data set may be added to the persistent data space as previously-described in connection with the first aspect of the invention.

The method may comprise the further steps of reading a first data set and its associated error detection code from the persistent data space during power on of the hearing aid and determine whether the first data set is a valid data set based on the associated error detection code. The first data set is skipped if it is invalid and data set(s) and its/their associated error detection code(s) is/are read from the persistent data space until a valid data set is identified. When a valid data set is found, values of the predetermined hearing aid associated variable(s) represented by the valid data set are activated by loading them into an operational part of the hearing aid processor's RAM and/or general-purpose register(s).

If the processor determines that none of the data sets in the persistent memory contains uncorrupted or valid data, the processor may notify the hearing aid user of the fact that an irrecoverable error condition has occurred by introducing a distinct notification signal into the processed output signal. Alternatively, an occurrence of an irrecoverable error condition may be conveyed to the hearing aid user by a visual signal on display means integrated with the aid. In that situation, the hearing aid is preferably adapted to halt all processing of the input signal and/or mute the processed output signal once the notification signal has been issued to avoid presenting annoying, or even harmful, sound pressure levels to the hearing aid user caused by activating erroneous value(s) of the predetermined hearing aid associated variable(s). Another possibility is, which may be acceptable for some applications, to completely discard the contents of the plurality of data sets if an irrecoverable error condition occurs and instead revert to using default value(s) of the predetermined hearing aid associated variable(s). This latter embodiment of the invention has the advantage that the user is not left in an unaided situation even though the performance of the hearing aid may be less than optimum.

A fifth aspect of the invention relates to a hearing aid comprising a persistent data space and a processor adapted to perform a method of saving data according to the above-mentioned fourth aspect of the invention.

BRIEF DESCRIPTION OF THE DRAWINGS

A preferred embodiment of the present invention in the form of a software programmable DSP based hearing aid is described in the following with reference to the drawings, wherein.

DETAILED DESCRIPTION OF A PREFERRED EMBODIMENT

Figure 1:
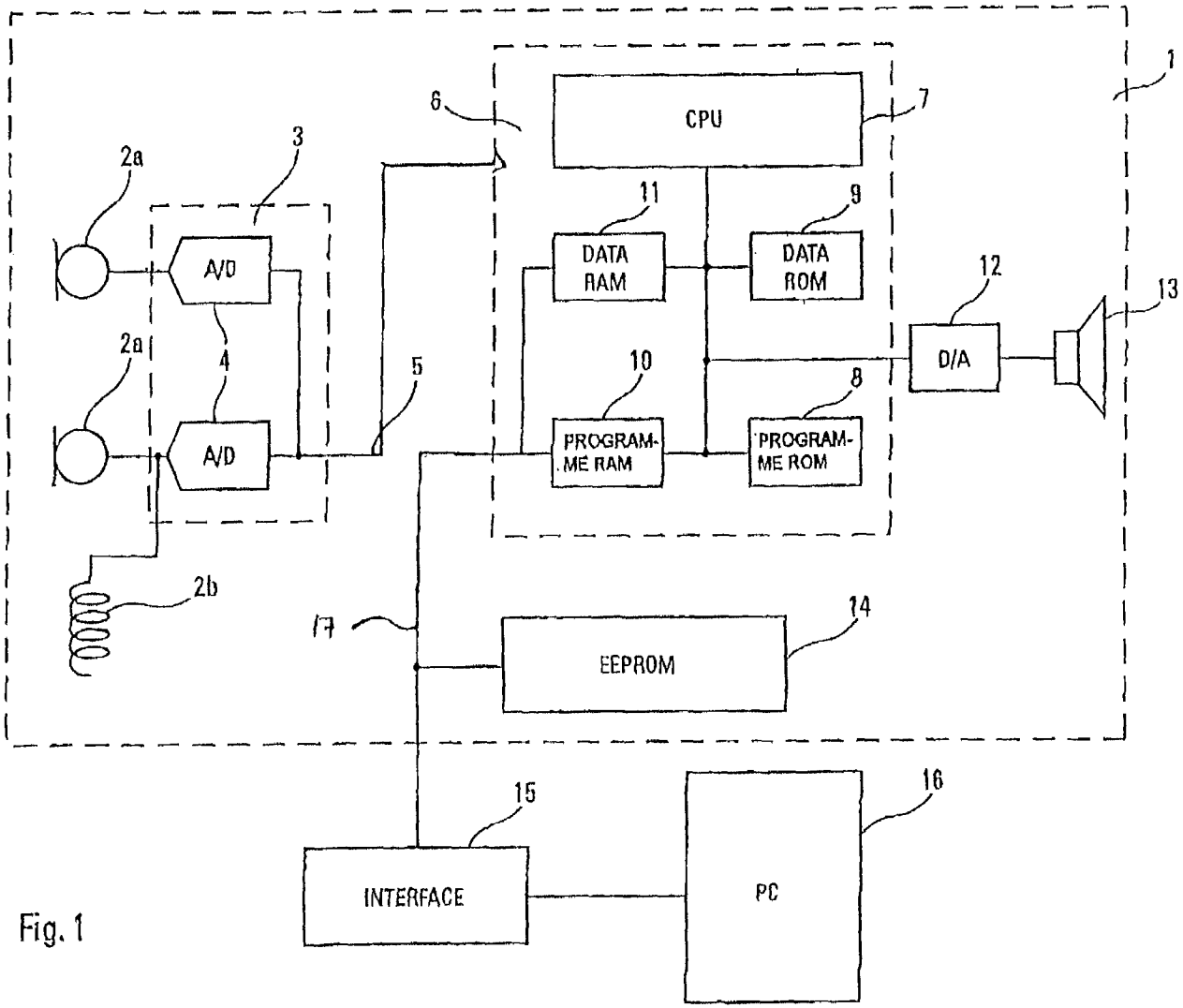
FIG. 1 shows a simplified block diagram of three-chip DSP based hearing aid according to the invention.

The block diagram of FIG. 1 illustrates a PC based host programming system 16 connected to a bi-directional programming data bus 17 of the DSP hearing aid 1 through and an interface device 15 so as to allow a PC based host programming system 16 to transfer software programs and/or associated data to the DSP hearing aid 1. During an initial fitting session in a hearing aid dispenser's office, subroutines or an entire software program can be loaded into and permanently stored in an industry standard type of serial EEPROM 14, capable of retaining its data when the normal power supply (not shown) of the hearing aid 1 is interrupted. The software program is loaded into a programme RAM 10 of the DSP 6 at boot time after power has been turned on in the hearing aid 1 while data variables such as algorithm parameters are loaded into a data RAM 11 at boot time.

The software program comprises a number of signal processing algorithms running on the DSP 6 in order to process digitised versions of microphone input signals generated from hearing aid microphones 2*a* and thereby provides a processed output signal to a hearing aid speaker or receiver 13. The software program furthermore comprises an EEPROM write subroutine adapted to store various hearing aid associated variables, including a 16 bit value of a gain multiplier, generated or provided by the DSP 6 within a predetermined storage area (20, FIG. 2) of the EEPROM 14.

The software program may furthermore comprise a number of software routines or subprograms responsible for handling a user interface part of the hearing aid that generates various parameter values or signal events associated with a number of user operable controls (not shown) provided on the hearing aid.

Figure 2:
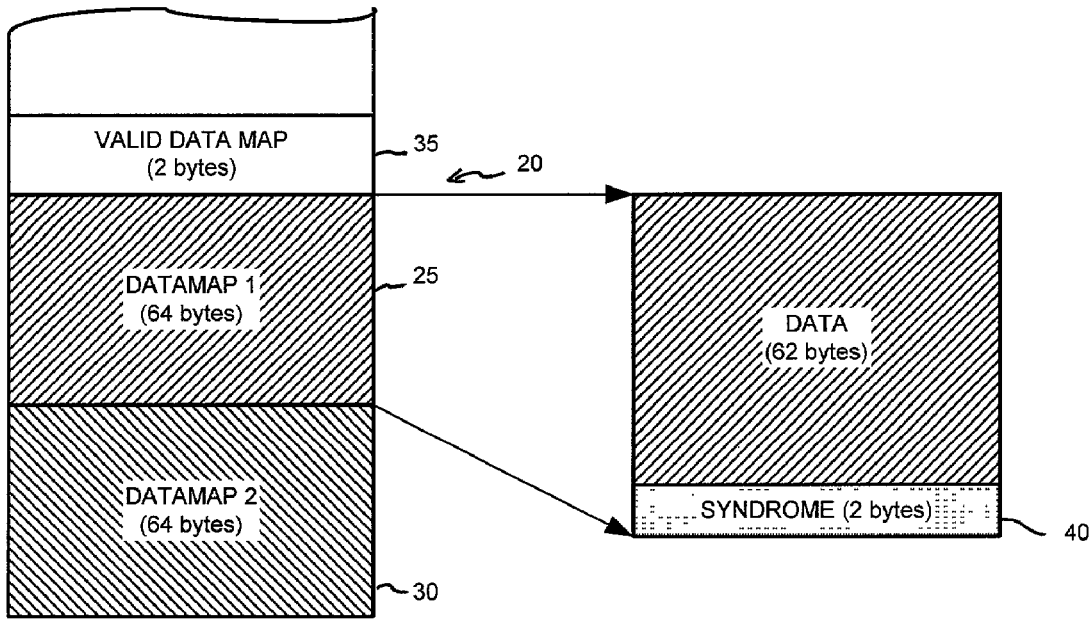
FIG. 2 illustrates a memory configuration of a persistent data space holding a first set of data, a second set of data and a data variable in the three-chip DSP based hearing aid.

FIG. 2 illustrates a preferred structure of the predetermined storage area 20 wherein a first storage area 25 is adapted to hold a first set of data, a second storage area 30 is adapted to hold a second set of data and a data variable within a valid data map 35 points to, or indicates, which of the first and second storage areas that contain valid data. For practical reasons, the size of the valid data map 35 has been selected to two bytes, but the data variable, or data pointer, stored therein is binary, i.e. can only assume one of two possible values: zero or a value different from zero. Each of the first and second storage areas comprises 64 bytes, which is the size of a so-called "page", i.e. a type of predetermined memory segment, in the preferred EEPROM 14 which is a low-voltage serial EEPROM with a storage capacity of 64 kbit. Each storage area is therefore positioned wholly within its own dedicated page, or memory segment, of the EEPROM 14 so that even if all contents, including the data set in question, in that page for some reason get corrupted, the other data set in the other page will be left unaffected The valid data map 35 is furthermore also located in its own dedicated page The provision of separate pages for the data sets and valid data map secures that power failures, or other data error-inducing events, happening while a data are written to a page can be confined to that page and its corresponding values of the hearing aid associated variables.

In the present embodiment of the invention, the first and second set of data comprise respective values of the gain multiplier in one of two input signal channels associated with the analogue-to-digital converters 4 (A/Ds). During normal operation of the DSP based hearing aid 1, updated values of this gain multiplier are continuously calculated by a microphone matching subroutine of the software program and intermittently written to the first and second storage areas 25, 30, respectively, at regular time intervals. The current value of the gain multiplier is derived from differences between power level estimates of the microphone input signals This adaptive or dynamic level matching scheme secures that long-term matching of the responses between the pair of omni-directional microphones 2*a* can be maintained so as to maintain long-tern optimum directional characteristics in the DSP hearing aid 1 when operated in a directional mode At boot time, the DSP 6 reads the value of the data variable from the valid data map area 35 and loads the gain multiplier from the indicated set of data into an internal register of the DSP 6. Data stored within each of the first and second storage areas are also provided with an associated checksum 40 to make it possible for the DSP 6 to detect whether the data contents has been corrupted by one or a few isolated bit errors that may have been introduced during a read/write sequence of the first or second set of data. To support an optimum degree of system safety, the DSP 6 may advantageously be adapted to at boot time start out by reading the value of the data variable and load the indicated set of data into an intermediate register or storage area of the DSP 6. Thereafter, the DSP 6 may calculate a checksum of the set of data that are held in the intermediate register and determine whether the checksum of the data set is correct or not. If the checksum is incorrect the processor may skip the data set and thus avoid that the corrupted data are loaded into an operational register or other storage area of the DSP 6. Clearly, other types of error detection and/or correction codes could also be applied to the first and second data sets such as Hamming codes, parity based codes etc.

If the checksum of the presently loaded set of data, unexpectedly, turns out to be incorrect as previously-mentioned, the DSP 6 may proceed to read the other set of data from the persistent data space 20, because this other set of data typically will contain uncorrupted and useable data, albeit slightly older than the initially indicated set of data. The DSP 6 may use such older set of data as an operational set of data provided that the associated checksum is correct. On the other hand, if the checksum of these older data is wrong also, it is preferred to either revert to using a default value of the variable(s) or parameter(s) stored in the two data sets, i.e. a default value of the gain multiplier in the present embodiment of the invention, or, alternatively, interrupt the operation of the hearing aid. If the operation of the hearing aid is interrupted, the user has preferably been alerted about the encountered error condition previously, e.g. by a distinct audible error signal or by a displaying a visual error signal.

The EEPROM 14 included in the present embodiment of the invention is an external industry standard device of serial type with a clock and data line interface for synchronous communication with the DSP 6. A complete write sequence of a data set to a particular page requires a significant amount of time for the selected EEPROM type. For a data set that contains 64 bytes, the write sequence may last up to 20 ms and, therefore, the software program of the DSP 6 may advantageously be adapted to handle such long write sequences without introducing audible and annoying drop outs in the processed output signal to the hearing aid user. Continuous operation of the audio processing capability of the DSP 6 may be accomplished by including a hardware, or software, based dedicated state machine within the DSP 6 to handle the EEPROM write task in parallel with the processing of the digital input signal or signals.

The present embodiment of the invention uses a software based dedicated state machine that utilises, or steals, suitable instruction cycles from the DSP 6 within a block based processing scheme. Alternatively, the persistent data space could be integrated on the same die as the DSP 6, e.g. in form of a customised EEPROM circuit or RAM circuit with a backup power supply. In this latter situation, it may be feasible, depending on the amount of data in the data set in question and the maximum possible write speed of the persistent data space, to write the contents of the entire data set to the persistent data space in a single operation.

The invention claimed is:

1. A method of saving data within a persistent data space of a hearing aid, the method comprising the steps of:

processing an input signal by a processor according to a predetermined algorithm to generate a processed output signal, generating a first data set, representing a value or values of one or several hearing aid associated variable(s), by the processor, writing the first data set to a respective storage area within the persistent data space, generating a second data set, representing an updated value or values of the one or several hearing aid associated variable(s), by the processor, writing the second data set to a different respective storage area within the persistent data space, and indicating one of the first and second data sets as a valid data set, by setting a value of at least one data variable in the persistent data space.

2. A method according to claim 1, wherein the processor reads the value of the at least one data variable during power on of the hearing aid to identify and load the valid data set of the plurality of data sets.

3. A method according to claim 1, wherein the plurality of data sets are written to their respective storage areas in an intermittent manner.

4. A method according to claim 1, wherein the plurality of data sets are written to the persistent data space during normal operation of the hearing aid.

5. A method according to claim 1, wherein the plurality of data sets comprise respective data representing accumulated utilisation time values of the hearing aid.

6. A method according to claim 1, wherein the plurality of data sets comprise respective data representing values of signal processing parameters of the predetermined algorithm.

7. A method according to claim 1, wherein the persistent data space is arranged in one or several memory device(s) selected from the group consisting of: (EEPROM, EPROM, Flash Memory, RAM powered by a back-up voltage).

8. A method according to claim 7, wherein the persistent data space is arranged in a single external EEPROM device and each data set of the plurality of data sets is placed in a separate memory-page of the external EEPROM.

9. A method according to claim 1, wherein each data set of the plurality of data sets is written to the persistent data space at regular time intervals, the time interval being between 5 minutes and 60 minutes.

10. A method according to claim 1, wherein the at least one data variable is stored within the persistent data space in a storage area separate from the respective storage areas of the plurality of data sets.

11. A method according to claim 1, wherein each data set comprises a data variable indicating whether that data set is the valid data set.

12. A method according to claim 11, wherein the data variables of the plurality of data sets are represented by respective counter values.

13. A method according to claim 1, wherein each data set of the plurality of data sets is associated with an error detection or error correction code within the persistent data space.

14. A method according to claim 1, wherein the plurality of data sets are constituted by a first and a second data set, and the at least one data variable comprises a single binary data variable indicating the valid data set.

15. A hearing aid comprising a persistent data space and a processor adapted to perform a method of saving data according to claim 1.

16. A method according to claim 1, wherein one of the value or values associated wit the first data set, and one of the updated value or values associated with the second data set, correspond to a same parameter.

17. A method according to claim 16, wherein the parameter is selected from the group consisting of a preset switch operation, a volume control operation, and a variable for use in a signal processing algorithm.

18. A hearing aid adapted to store values of hearing associated variables in a persistent memory device during normal use of said hearing aid, the bearing aid comprising:

an input signal channel providing an input signal, a processor adapted to:

process the input signal according to a predetermined algorithm to generate a processed output signal, generate a first data set representing a value or values of one or several hearing aid associated variable(s), write the first data set to a first memory segment within the persistent memory device, generate a second data set representing an updated value or values of the one or several hearing aid associated variable(s), write the second data set to a second memory segment within the persistent memory device, selectively indicate the first or the second data set as a valid data set by setting a data variable value in a third memory segment in the persistent memory device.

19. A hearing aid according to claim 18, wherein the persistent memory device is a serial EEPROM.

20. A hearing aid according to claim 19, wherein each of first, second and third memory segments is placed in a separate memory-page of the serial EEPROM.

21. A hearing aid according to claim 18, wherein one of the value or values associated with the first data set and one of the updated value or values associated with the second data set, correspond to a same parameter.

22. A hearing aid according to claim 21, wherein the parameter is selected from the group consisting of a preset switch operation, a volume control operation, and a variable for use in a signal processing algorithm.

* * * * *

UNITED STATES PATENT AND TRADEMARK OFFICE

CERTIFICATE OF CORRECTION

PATENT NO. : 7,283,638 B2
APPLICATION NO. : 10/007823
DATED : October 16, 2007
INVENTOR(S) : Casper Troelsen et al.

It is certified that error appears in the above-identified patent and that said Letters Patent is hereby corrected as shown below:

On the Title Page, Item (56) References Cited, please correct the following:

-- Foreign Patent Documents

From ~~EP 0 341 908 A2~~ to EP 0 341 903 A2

Signed and Sealed this

Twenty Second Day of April, 2008

JON W. DUDAS
*Director of the United States Patent and Trademark Office*